US008136742B2

(12) United States Patent
Cordua

(10) Patent No.: US 8,136,742 B2
(45) **Date of Patent: *Mar. 20, 2012**

(54) TELESCOPING POP-UP SPRINKLER

(76) Inventor: Paul M. Cordua, Lindsay, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/908,769

(22) Filed: Oct. 20, 2010

(65) Prior Publication Data

US 2011/0036925 A1 Feb. 17, 2011

Related U.S. Application Data

(63) Continuation of application No. 12/368,152, filed on Feb. 9, 2009, now Pat. No. 7,823,804, which is a continuation of application No. 11/193,289, filed on Jul. 29, 2005, now Pat. No. 7,500,620.

(51) Int. Cl.
*B05B 15/10* (2006.01)

(52) U.S. Cl. ..... 239/205; 239/203; 239/204

(58) Field of Classification Search ..... 239/200–206, 239/600

See application file for complete search history.

(56) References Cited

U.S. PATENT DOCUMENTS

| | | | | |
|---|---|---|---|---|
| 3,104,822 | A | 9/1963 | Muschett | |
| 3,589,616 | A | 6/1971 | Stephens | |
| 4,753,391 | A | 6/1988 | Rogers | |
| 5,163,618 | A | 11/1992 | Cordua | |
| 5,265,803 | A | 11/1993 | Thayer | |
| 5,921,322 | A | 7/1999 | Bonfield et al. | |
| 6,216,963 | B1 | 4/2001 | Bonfield et al. | |
| 6,547,159 | B1 | 4/2003 | Westby | |
| 6,619,570 | B1 | 9/2003 | Ericksen et al. | |
| 6,629,648 | B1 | 10/2003 | Jones | |
| 6,874,696 | B1 | 4/2005 | Ericksen et al. | |
| 6,921,029 | B2 | 7/2005 | Lockwood | |
| 7,500,620 | B2 * | 3/2009 | Cordua | 239/204 |
| 7,823,804 | B2 * | 11/2010 | Cordua | 239/205 |

* cited by examiner

*Primary Examiner* — Davis Hwu
(74) *Attorney, Agent, or Firm* — Fulwider Patton LLP

(57) ABSTRACT

The telescoping pop-up sprinkler includes a telescoping piston assembly that allows the piston assembly of the pop-up to extend upwards at a greater height than the length of the pop-up sprinkler body. The telescoping pop-up sprinkler has a main body with a piston assembly that includes two or more pistons that engage internally with one another, with stops provided at one end of each piston to limit the stroke of each piston. Multiple internal seals are provided to prevent the bypassing of water around the outer diameter of each piston.

9 Claims, 5 Drawing Sheets

TELESCOPING POP-UP SPRINKLER

RELATED APPLICATIONS

This Application is a Continuation Application of Continuation application Ser. No. 12/368,152, filed Feb. 9, 2009, now U.S. Pat. No. 7,823,804, which is a continuation of Ser. No. 11/193,289, filed Jul. 29, 2005, now U.S. Pat. No. 7,500,620, the entire contents of each incorporated by reference herein.

BACKGROUND OF THE INVENTION

1. Field of the Invention

This invention relates generally to irrigation sprinklers or sprayheads, and more particularly relates to a telescoping pop-up sprinkler assembly for extending the height of a sprinkler.

2. General Background and State of the Art

An advantage of a pop-up sprinkler over a permanently upright sprinkler extending above the ground is that the entire sprinkler remains buried in the ground until the pop-up sprinkler is activated by water pressure, when the piston is pushed above ground level to spray water. By remaining buried in the ground until activated, damage to the sprinkler can be prevented or minimized that might otherwise occur if the sprinkler were permanently in an upright position above ground level.

Pop-up irrigation sprinklers are commonly manufactured in heights from two to twelve inches. Such pop-up sprinklers usually include a cap, a seal, a piston, a spring, a ratchet and a body. The body is usually longer than the height of the pop-up sprinkler, to allow sufficient space in the body for the spring, seal and end of the piston. For example, a two inch pop body would be four inches long, to allow two inches of piston extension, leaving two inches of piston in the body to support the piston from a side thrust when a half spray nozzle is used, and leaving space for the spring in the compression stage. As heights change in order to achieve adequate spray patterns over taller grasses or shrubbery, tall sprinklers are used. Usually the piston length increases in direct relation the increase in the length of the body of the sprinkler. With a six inch pop-up sprinkler, the sprinkler body is typically about nine inches long, to account for the additional leverage created by the increased height of the pop-up piston. In a twelve pop-up sprinkler, the sprinkler body is typically about fifteen inches long.

It should be readily apparent that for installation of a pop-up sprinkler the hole or trench that has to be dug would need to exceed the total length of the body of the pop-up sprinkler, as well as the height of the connector used to attach the body of the pop-up sprinkler to a water supply pipe, plus the diameter of the water supply pipe. For example, for installation of a two inch pop-up sprinkler, a trench would need to be a minimum of six inches deep if not up to ten inches deep, and for installation of a twelve inch pop-up sprinkler, the trench may be up to eighteen inches or twenty-four inches deep.

It would be desirable to provide a pop-up sprinkler that telescopes to extend the height of the sprinkler, to reduce the depth of trenches needed for installation of the pop-up sprinkler, and to minimize installation time and expense. It would also be desirable to provide a pop-up sprinkler with improved seals for the telescoping piston assembly. The present invention satisfies these and other needs.

INVENTION SUMMARY

Briefly, and in general terms, the invention provides for a telescoping pop-up sprinkler with a telescoping piston assembly that allows the piston assembly of the pop-up to extend upwards at a greater height than the length of the pop-up sprinkler body. The telescoping pop-up sprinkler has a main body with a piston assembly that includes two or more pistons that engage internally with one another, with stops provided at one end of each piston to limit the stroke of each piston. Multiple internal seals are provided to prevent the bypassing of water around the outer diameter of each piston.

The telescoping pop-up sprinkler is designed so that the tubular main body is longer than the height of the pop-up sprinkler, to allow sufficient space in the body for the spring, seal and the primary and secondary pistons. For example, the telescoping pop-up sprinkler would typically provide a four inch body for a seven inch extension of the piston assembly, or a six inch body for a thirteen inch extension of the piston assembly. In the latter example, a trench would only have to be dug ten inches to twelve inches deep to install a pop-up sprinkler that would extend thirteen inches, in comparison to an ordinary twelve inch pop-up sprinkler that would require a trench from eighteen to twenty-four inches in depth. In addition, the telescoping pop-up sprinkler of the invention will allow a pop-up sprinkler with a twelve inch body to be able to extend eighteen inches or more, and still keep the depth of the trench at eighteen to twenty-four inches.

The present invention accordingly provides for a telescoping pop-up sprinkler head including a tubular main body and a telescoping piston assembly disposed in the tubular main body. The telescoping piston assembly includes a primary piston and a secondary piston engaged together in telescoping, sliding relationship. The primary piston has a tubular body with a retaining flange at a lower end, and a primary spring disposed over the tubular body of the primary piston above the retaining flange of the tubular body of the primary piston. The upper surface of the retaining flange includes a plurality of detents, and a ratchet member that interacts with the plurality of detents is disposed over the tubular body of the primary piston at the lower end of the primary piston between the primary spring and the retaining flange. The ratchet member engages with the plurality of internal ribs in the tubular main body. A cap is disposed on the upper end of the tubular main body, retaining a primary seal disposed over the tubular body of the primary piston in the tubular main body to seal the tubular main body, cap and primary piston from leaking water. The primary seal is currently a chevron type of seal, having an inner sealing flap that is activated by external water pressure. A spring retainer is disposed between the primary seal and the primary spring to prevent pressure from the primary spring against the primary seal from distorting the primary seal. The spring retainer also has slots in it to allow water pressure to activate the chevron seal during operation of the sprinkler.

The secondary piston has a tubular body with a lower retaining flange having a plurality of radial slots adapted to interfit with the plurality of internal ribs of the tubular body of the primary piston. The radial slots in the lower retaining flange correspond to and engage the plurality of internal ribs in the primary piston, to keep the secondary piston from rotating, and allow water to pass between primary and secondary pistons to activate the chevron seal on the secondary seal. A secondary chevron seal is disposed over the tubular body of the secondary piston within the tubular body of the primary piston to seal the primary piston and the secondary piston from leaking water, commonly called "flow by." A seal retainer is threadably engaged in the upper end of the tubular body of the primary piston to holds the secondary seal in place in the primary piston. The tubular body of the primary piston also includes an annular internal stop for retaining the secondary seal between the annular internal stop and the seal retainer. The annular internal stop in the primary piston is slotted to let water pressure through to activate the chevron seal on the secondary seal to activate it against the secondary piston to stop flow by. A secondary spring is disposed over the tubular body of the secondary piston between the retaining flange of the tubular body of the secondary piston and the annular internal stop of the tubular body of the primary piston.

Other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
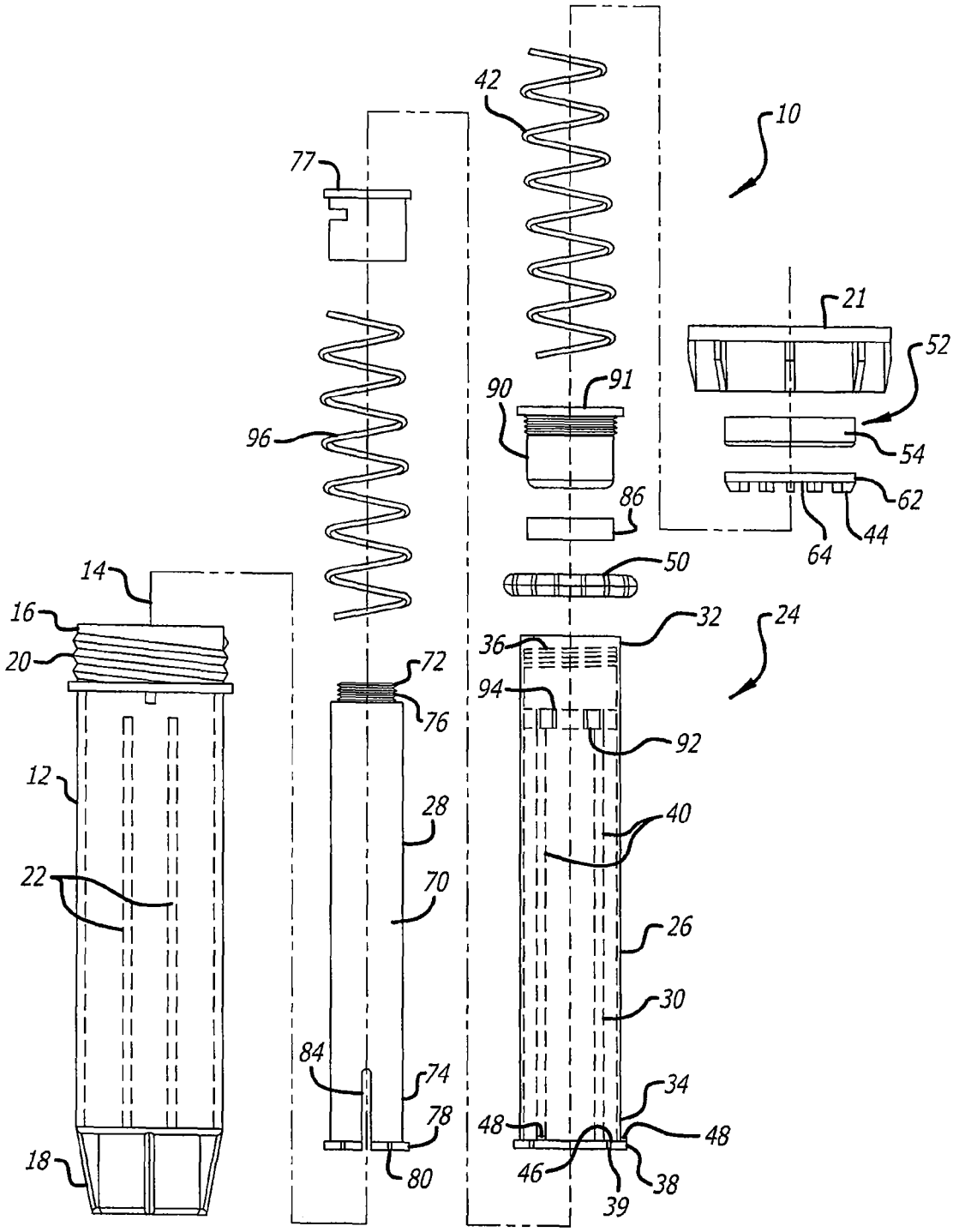
FIG. 1 is an exploded view of the telescoping pop-up sprinkler according to the present invention.
Figure 2:
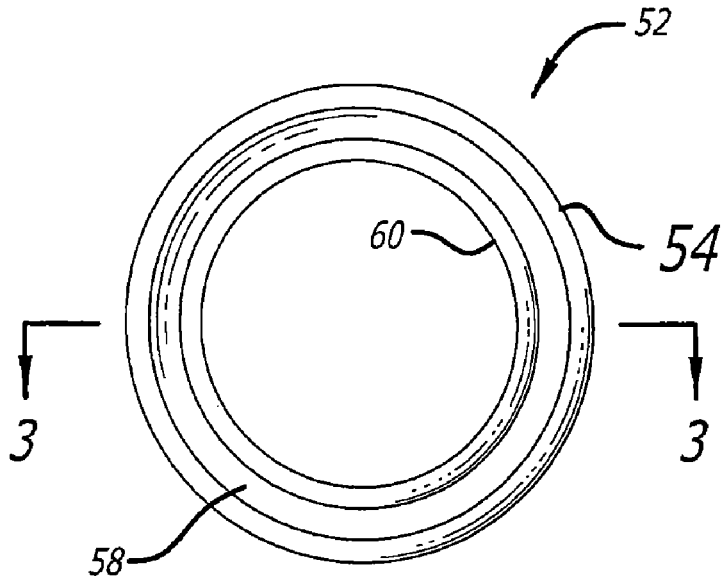
FIG. 2 is a plan view of a primary chevron seal of FIG. 1.
Figure 3:
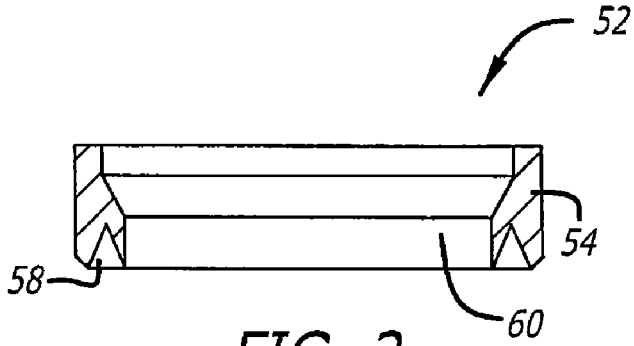
FIG. 3 is a cross-sectional view of the primary chevron seal taken along line 3-3 of FIG. 2.

Referring to the drawings, which are provided for purposes of illustration and by way of example, the present invention provides for a telescoping pop-up sprinkler 10 connectable with a source of pressurized fluid, such as a water supply pipe (not shown). The telescoping pop-up sprinkler includes a tubular main body 12 having a longitudinal axis 14, an upper end 16, and a lower connector end 18. The upper end of the tubular main body has external threads 20 for receiving a cap 21, and the lower connector end is adapted to be connected to the source of pressurized fluid. The lower connector end may have internal threads 19, for connection to a water supply pipe, for example. The tubular main body has an inner surface defining a plurality of internal ribs 22 extending longitudinally in the tubular main body.

The telescoping pop-up sprinkler also includes a telescoping piston assembly 24 disposed in the tubular main body. The telescoping piston assembly includes a primary piston 26 and a secondary piston 28. The primary piston has a tubular body 30 with an upper end 32 and a lower end 34. The upper end is currently preferably internally threaded 36, and the lower end includes a retaining flange 38 with a plurality of radial slots 39 to allow water to pass up to activate the primary seal, as will be further explained below. A plurality of internal ribs 40 are preferably formed on the inner surface of the tubular body of the primary piston and extending longitudinally in the tubular body of the primary piston. A primary spring 42 is disposed over the tubular body of the primary piston between the retaining flange of the tubular body of the primary piston and the spring retainer 44, described further below. In a currently preferred aspect, the upper surface 46 of the retaining flange includes a plurality of detents 48, and a ratchet member 50 that interacts with the detents of the retaining flange is disposed over the tubular body of the primary piston at the lower end of the primary piston, between the primary spring and the retaining flange. The ratchet member also engages with the plurality of internal ribs in the main body.

A primary seal 52 having an annular body 54 is disposed over the upper end of the tubular body of the primary piston, to seal the body, cap and primary piston from leaking water. In a currently preferred aspect, the primary seal is a chevron type of seal having a chevron or V-shaped groove 58 extending around the under side of the annular body of the seal, forming an inner flap 60 that operates as a pressure activated seal when the seal is pressurized by the pressurized fluid, such as water. The primary seal is currently preferably formed of a relatively pliable sealing material, such as a soft polytetrafluoroethylene seal material, available under the trade name Teflon from DuPont.

The spring retainer 44 has an annular body 62, with an opening 64 formed in the annular body extending through the spring retainer from the upper side to the lower side with a clearance sufficiently large to advantageously allow water pressure to activate the chevron seal during operation of the sprinkler. The spring retainer is disposed between the primary seal and the primary spring primarily to retain the primary spring when the sprinkler is assembled, and to prevent distortion of the primary seal by pressure from the primary spring. The cap is threadedly engaged on the upper end of the tubular main body, retaining the primary seal in the tubular main body. The cap has internal threads 68 engaging the external threads of the upper end of the tubular main body.

Figure 4:
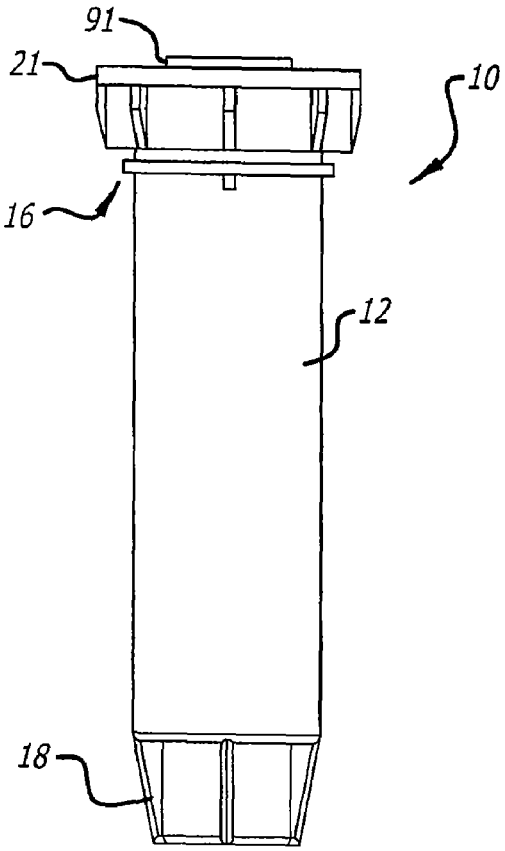
FIG. 4 is an elevational view of the telescoping pop-up sprinkler of FIG. 1 in an unextended configuration.
Figure 5:
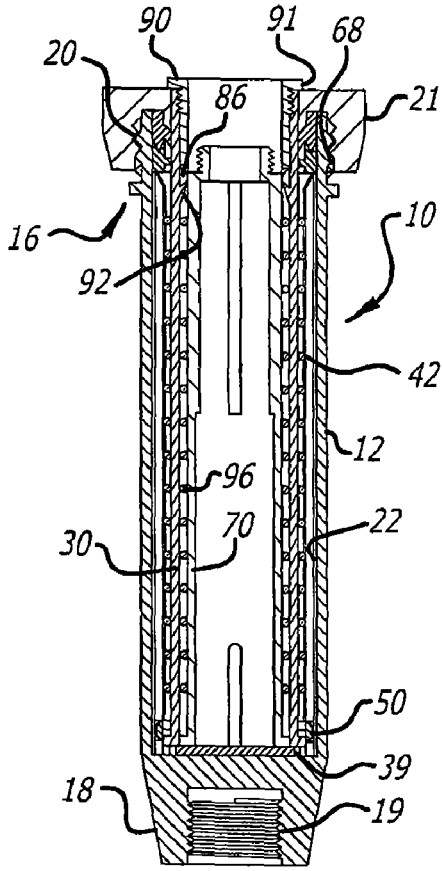
FIG. 5 is a cross-sectional view of the telescoping pop-up sprinkler of FIG. 1 in an unextended configuration.
Figure 6:
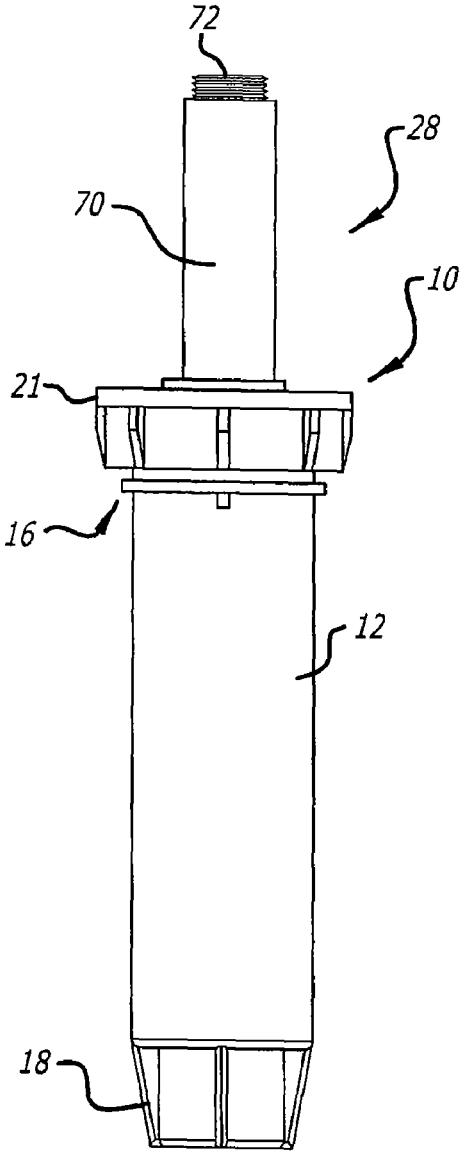
FIG. 6 is an elevational view of the telescoping pop-up sprinkler of FIG. 1 showing the secondary piston in an extended configuration.
Figure 7:
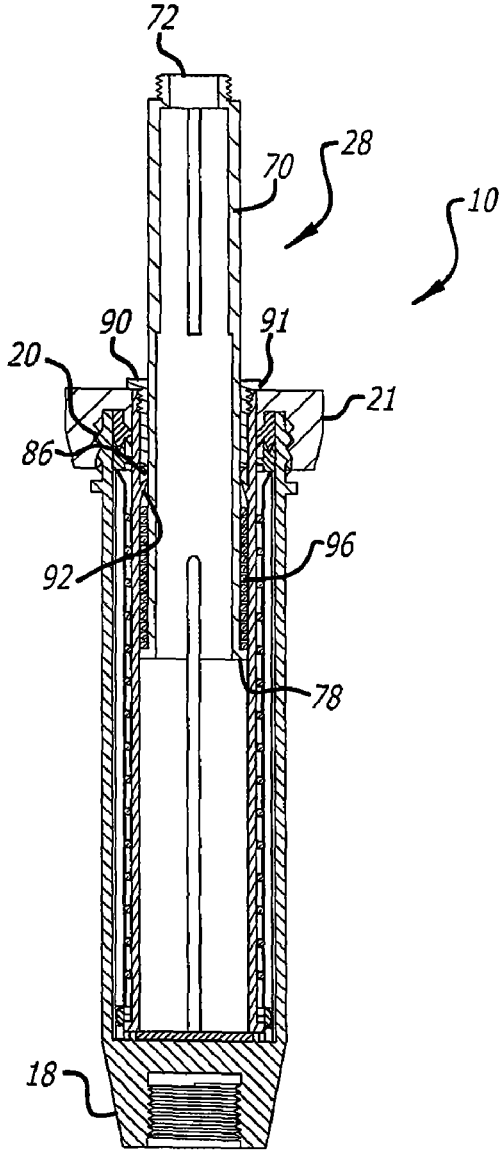
FIG. 7 is a cross-sectional view of the telescoping pop-up sprinkler of FIG. 1 showing the secondary piston in an extended configuration.
Figure 8:
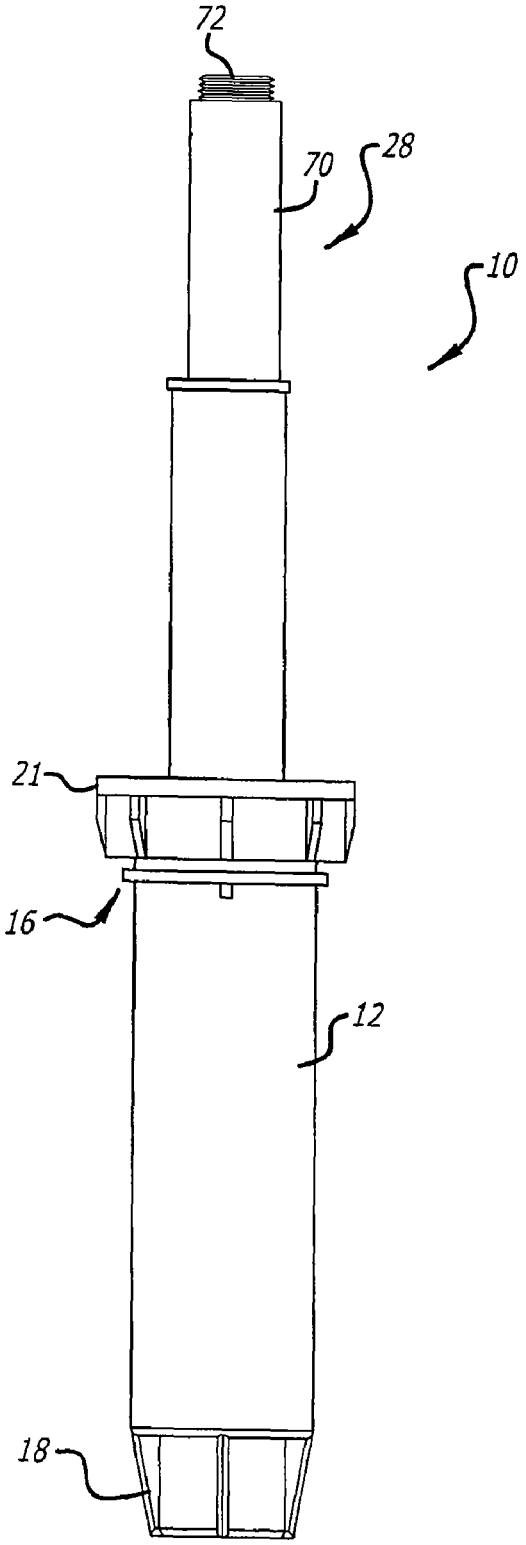
FIG. 8 is an elevational view of the telescoping pop-up sprinkler of FIG. 1 showing the primary and secondary pistons in an extended configuration.
Figure 9:
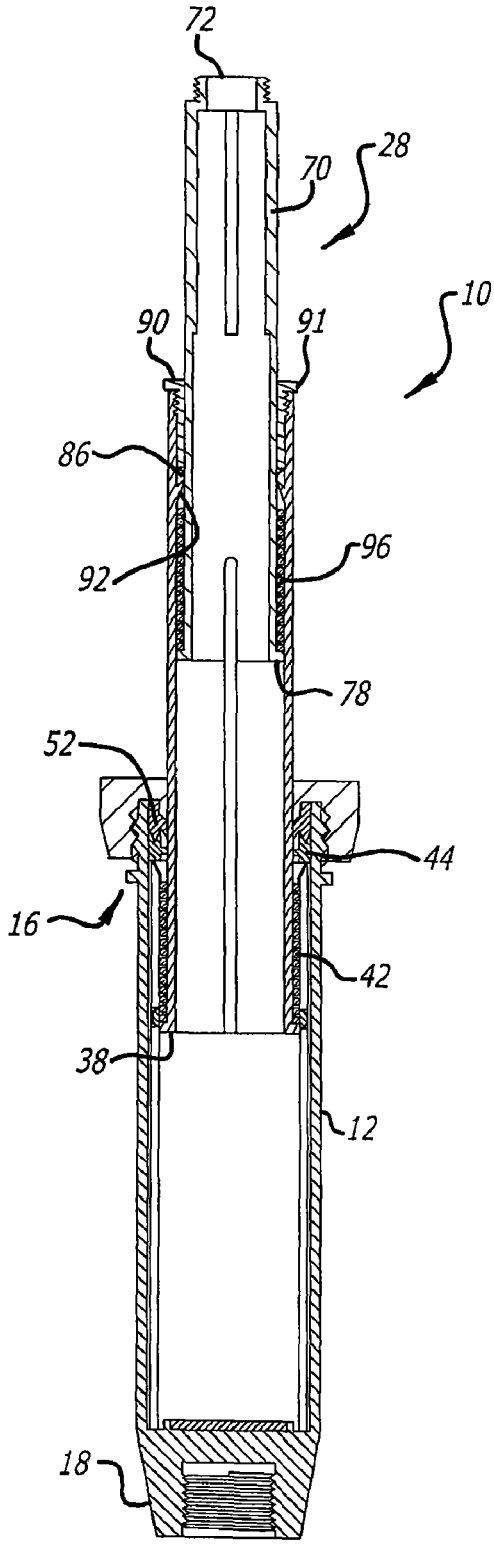
FIG. 9 is a cross-sectional view of the telescoping pop-up sprinkler of FIG. 1 showing the primary and secondary pistons in an extended configuration.

The secondary piston has a tubular body 70 with an upper end 72 and a lower end 74. The upper end currently preferably has external or internal threads 76 for receiving a sprinkler head or nozzle 77 with corresponding internal or external threads, illustrated in FIG. 1, and the lower end includes a retaining flange 78 with a plurality of radial slots 80 adapted to interfit with the plurality of internal ribs of the tubular body of the primary piston to keep the secondary piston from rotating. The lower end includes a longitudinal slot 84. A secondary seal 86 is disposed over the tubular body of the secondary piston within the tubular body of the primary piston to seal the primary piston and the secondary piston from leaking water. In a currently preferred aspect, the secondary seal is a chevron type of seal, as described above. The radial slots in the retaining flange of the secondary piston also allow water to pass between the primary and secondary pistons to activate the chevron seal on the secondary seal. A seal retainer 90 is threadably engaged in the upper end of the tubular body of the primary piston to hold the secondary seal in place in the primary piston. The upper flange 91 on the seal retainer 90 preferably is of a sufficiently large diameter to hold the piston assembly together when the sprinkler is assembled, and the flange sits on top of the cap 21 when the sprinkler is assembled, as shown in FIGS. 4, 5 and 7. When a sprinkler head or nozzle 77 is attached to piston 72 and the cap 21 is unscrewed from the body 12, the entire nozzle and piston assembly can be removed from the body 12, and stays intact. The tubular body of the primary piston includes an annular internal stop 92 for retaining the secondary seal between the annular internal stop and the seal retainer. In a currently preferred aspect, the annular internal stop in the primary piston includes an opening 94 with a sufficiently large clearance to let water pressure through to activate the "chevron" on the secondary seal to activate the secondary seal against the secondary piston to stop flow by. A secondary spring 96 is disposed over the tubular body of the secondary piston between the retaining flange of the tubular body of the secondary piston and the annular internal stop of the tubular body of the primary piston.

It should be recognized that the foregoing description relates primarily to dual stage telescoping piston. However, by enlarging the tubular main body in circumference, or installing a smaller third piston, the telescoping pop-up sprinkler can be made in multiple stages, increasing the height of the piston above the cap or ground level to even greater heights in relationship to the height of the body and the depth of the trench necessary to install the pop-up spray head to keep the telescoping pop-up sprinkler at ground level in the unextended position.

It will be apparent from the foregoing that, while particular forms of the invention have been illustrated and described, various modifications can be made without departing from the spirit and scope of the invention. Accordingly, it is not intended that the invention be limited, except as by the appended claims.

What is claimed is:

1. A telescoping pop-up sprinkler connectable with a source of pressurized fluid, the telescoping pop-up sprinkler head comprising:

a tubular main body with an upper end and a lower connector end, the upper end having external threads, and the lower connector end being adapted to receive pressurized fluid, the tubular main body having an inner surface defining a plurality of internal ribs extending longitudinally in the tubular body, and a telescoping piston assembly disposed in the tubular body, the telescoping piston assembly including a primary piston and a secondary piston engaged together in telescoping, sliding relationship;

the primary piston having a tubular body with an upper end and a lower end, the upper end being internally threaded, and the lower end having a retaining flange, and a primary spring disposed over the tubular body of the primary piston;

the secondary piston having a tubular body with an upper end and a lower end, and the lower end having a retaining flange, and a secondary spring disposed over the tubular body of the secondary piston between the retaining flange of the tubular body of the secondary piston and the annular internal stop of the tubular body of the primary piston, the retaining flange of the lower end of the secondary piston including a plurality of radial slots adapted to interfit with the plurality of internal ribs of the tubular body of the primary piston; and a ratchet member disposed over the lower end of the primary piston between the primary spring and the retaining flange, wherein said ratchet member engages said plurality of internal ribs of said tubular main body, and wherein the retaining flange of the primary piston has an upper surface including a plurality of detents that interact with said ratchet member.

2. The telescoping pop-up sprinkler of claim 1, further comprising a spring retainer disposed over the tubular body of the primary piston to retain the primary spring in position when the telescoping pop-up sprinkler is assembled, said spring retainer having an annular body with an opening extending through the annular body from an upper side to a lower side of the annular body.

3. The telescoping pop-up sprinkler of claim 1, further comprising a seal disposed over the tubular body of the secondary piston within the tubular body of the primary piston, and wherein said seal comprises an annular pressure activated seal.

4. The telescoping pop-up sprinkler of claim 3, wherein said seal comprises an annular seal having a chevron shaped groove extending around an underside of the annular seal, forming an inner sealing flap that operates as a pressure activated seal when the seal is pressurized by the pressurized fluid.

5. The telescoping pop-up sprinkler of claim 3, further comprising a seal retainer on the upper end of the tubular body of the primary piston to retain the seal in the primary piston.

6. The telescoping pop-up sprinkler of claim 5, wherein the tubular body of the primary piston includes an annular internal stop retaining the seal between the annular internal stop and the seal retainer.

7. The telescoping pop-up sprinkler of claim 6, wherein the annular internal stop in the primary piston is slotted to permit water pressure through the annular stop to the seal.

8. The telescoping pop-up sprinkler of claim 1, further comprising a cap disposed on the upper end of the tubular main body, wherein said cap holds the primary and secondary pistons together when the telescoping pop-up sprinkler is assembled.

9. The telescoping pop-up sprinkler of claim 8, further comprising a nozzle attached to said secondary piston to form a nozzle and piston assembly, and wherein when said cap is removed from the body, said nozzle and piston assembly can be removed from the body intact.

* * * * *